US005106946A

United States Patent [19]

Clark, III et al.

[11] Patent Number: 5,106,946

[45] Date of Patent: Apr. 21, 1992

[54] HIGH TENACITY, HIGH MODULUS POLYAMIDE YARN AND PROCESS FOR MAKING SAME

[75] Inventors: Thomas R. Clark, III; Joseph A. Cofer, Jr., both of Hixson, Tenn.

[73] Assignee: E. I. Du Pont de Nemours and Company, Wilmington, Del.

[21] Appl. No.: 424,846

[22] Filed: Oct. 20, 1989

[51] Int. Cl.[5] ..... C08G 69/26

[52] U.S. Cl. ..... 528/335; 528/323

[58] Field of Search ..... 528/335, 323

[56] References Cited

U.S. PATENT DOCUMENTS

| | | | |
|---|---|---|---|
| 4,496,630 | 1/1985 | Kurita et al. | 428/364 |
| 4,504,545 | 3/1985 | Kurita et al. | 428/364 |
| 4,701,377 | 10/1987 | Kurita et al. | 428/364 |
| 4,758,472 | 7/1989 | Kitamura | 428/364 |

FOREIGN PATENT DOCUMENTS

| | | |
|---|---|---|
| 62-110910 | 5/1987 | Japan . |
| 62-133108 | 6/1987 | Japan . |
| 62-133109A | 6/1987 | Japan . |
| 63-159517A | 7/1988 | Japan . |

*Primary Examiner*—Harold D. Anderson

[57] ABSTRACT

A yarn comprised of a polyamide which is at least about 85% poly(hexamethylene adipamide) or poly(ε-caproamide) is disclosed which has a relative viscosity of greater than about 50, a tenacity of greater than about 11.0 g/d, a dry heat shrinkage at 160° C. of not more than about 6.5 percent, a boil-off shrinkage of less than about 7%, a modulus of greater than about 35 g/d, a birefringence of greater than about 0.060, a differential birefringence D: $\Delta_{0.90-0.00}$, of greater than 0, and a sonic modulus of greater than about 90 g/d. The process for making the yarn includes drawing of a feed yarn while heating to at least about 185° C. in at least a final draw stage to a draw tension of at least 3.8 g/d, subsequently decreasing the tension while heating to at least about 185° C. to produce a length decrease of between about 2 and about 13.5, and cooling and packaging the yarn.

14 Claims, 1 Drawing Sheet

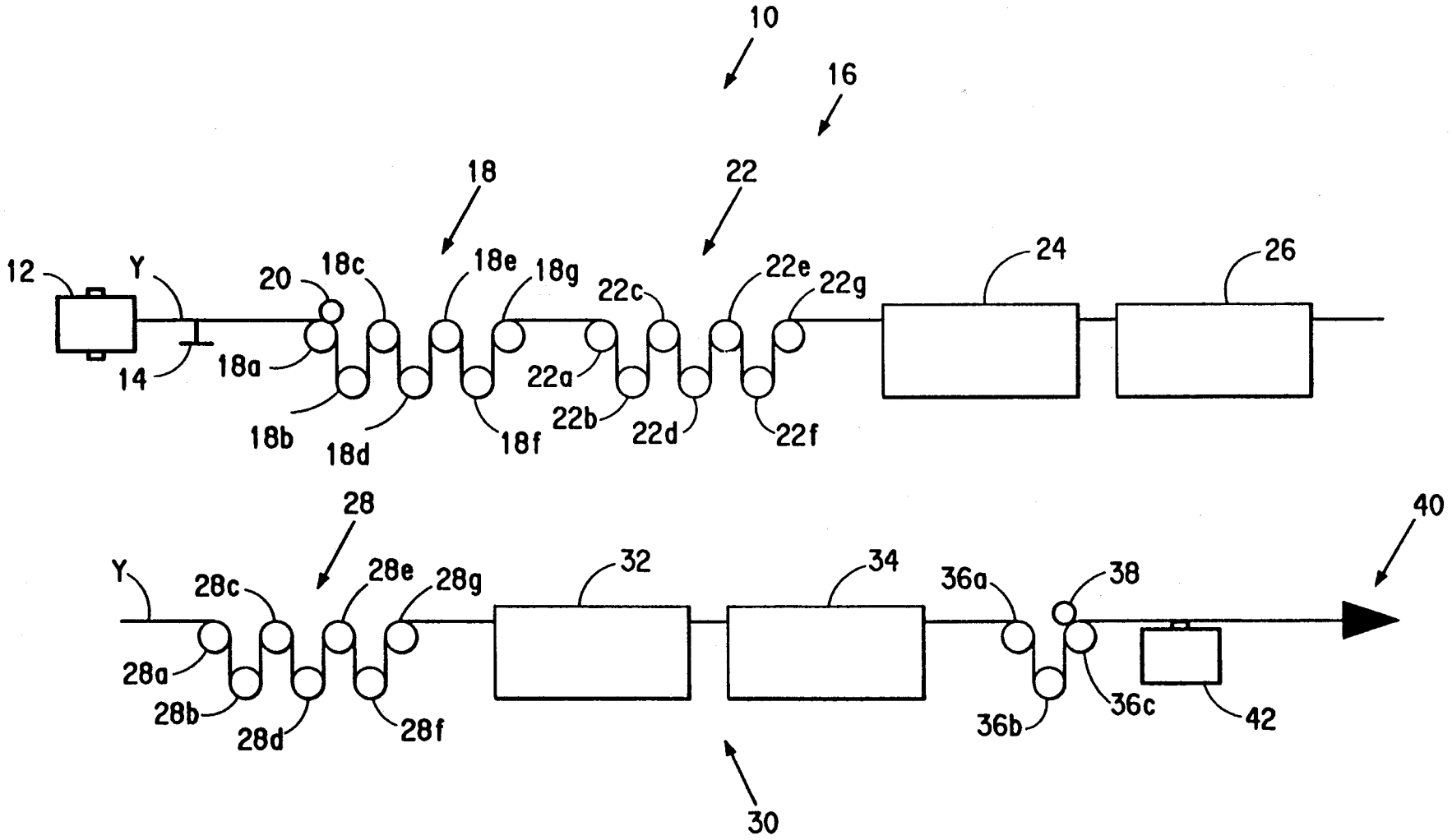
10
12
14
16
18
18a
18b
18c
18d
18e
18f
18g
20
22
22a
22b
22c
22d
22e
22f
22g
24
26
28
28a
28b
28c
28d
28e
28f
28g
30
32
34
36a
36b
36c
38
40
42
Y
Y

HIGH TENACITY, HIGH MODULUS POLYAMIDE YARN AND PROCESS FOR MAKING SAME

BACKGROUND OF THE INVENTION

The present invention relates to industrial polyamide yarns and more particularly relates to very high tenacity polyamide yarn with high modulus and having acceptably low shrinkage and a process for making such yarns.

A wide variety of high tenacity polyamide yarns are known and are used commercially for a variety of purposes. Many of such polyamide yarns are useful in cords for tires and other applications due to high tenacity, i.e., up to but generally not exceeding 10.5 g/d. Such yarns also have tolerable levels of shrinkage for conversion to selected industrial applications such as tire cords, typically 5-10% at 160° C. For most applications in which it is desirable to use a high tenacity yarn, yarns with a higher tenacity than that found in tire yarns would be desirable provided that shrinkage is controlled to low or moderate levels and modulus is kept high.

Low shrinkage yarns with high tenacity levels have been made using processes employing treatment steps such as steaming for relatively long periods after drawing but such processes are usually not well-suited for commercial production. In addition, the yarns made by such processes typically have greatly reduced modulus levels.

A polyamide yarn with a tenacity measured on a yarn basis of greater than about 11 g/d with an acceptable level of shrinkage and high modulus would be highly desirable for many industrial applications, particularly with other desirable properties including high sonic modulus and birefringence. Such yarns would be even more desirable if the yarns were readily manufactured in a commercially-feasible process.

SUMMARY OF THE INVENTION

In accordance with the invention, a polyamide yarn is provided comprised of at least about 85% by weight of a polyamide selected from the group consisting of poly(hexamethylene adipamide) and poly(ε-caproamide) is provided which has a relative viscosity of greater than about 50, a tenacity of greater than about 11.0 g/d, a dry heat shrinkage at 160° C. of not more than about 6.5%, a boil-off shrinkage of less than about 7%, a modulus of at least about 35 g/d, a birefringence of greater than about 0.060, a differential birefringence D: $\Delta_{0.90-0.00}$ of greater than O, and a sonic modulus of greater than about 90 g/d.

In accordance with a preferred form of the present invention, the yarn has a modulus of at least 40 g/d, a crystal perfection index of greater than about 73 and a long period spacing of greater than about 100Å. Most preferably the modulus of the yarn is greater than about 45 g/d. Preferred yarns in accordance with the invention have a tenacity greater than about 11.5 g/d and an elongation to break of greater than about 15%. Values for normalized elastic range of greater than about 0.55 and a normalized yield stress of greater than about 0.78 are advantageously found in preferred yarns of the invention.

The novel high tenacity yarns in accordance with the invention provide tenacities of greater than about 11.0 g/d while also maintaining an excellent combination of other end-use characteristics including acceptably low shrinkage, i.e., a dry heat shrinkage of not more than about 6.5% at 160° C. and a boil-off shrinkage of less than about 7%, and a high modulus level. In preferred yarns, a very high modulus level is provided as well as high values for normalized elastic range and normalized yield stress indicating that the external stress on the fiber is more uniformly distributed across the load bearing connector molecules than in known fibers.

In accordance with the invention, a process is provided for making a polyamide yarn having a tenacity of greater than about 11.0 g/d, a modulus of at least about 35 g/d and a dry heat shrinkage of not more than about 6.5% from a drawn, partially-drawn, or undrawn polyamide feed yarn. The process includes drawing the yarn in at least a final drawing stage while heating the feed yarn. The drawing and heating is continued until the draw tension reaches at least about 3.8 g/d when the yarn is heated to a yarn draw temperature of at least about 185° C., preferably, at least about 190° C. The tension on the yarn is decreased after drawing sufficiently to allow the yarn to decrease in length to a maximum length decrease between about 2 and about 13.5%, preferably between about 2 and about 10%. During the carefully controlled tension reduction, the yarn is heated to a final yarn relaxation temperature of at least about 185° C., preferably at least about 190° C., when the maximum length decrease is reached.

In a preferred process, the decreasing of the tension is performed by decreasing the tension partially in at least an initial relaxation increment to cause an initial decrease in length and then further decreasing the tension to cause the yarn to decrease further in length to its maximum length decrease in at least a final relaxation increment. In a preferred process for poly(hexamethylene adipamide) yarns, the yarn relaxation temperature is attained by heating in an oven at a temperature between about 220° and about 320° C. with residence time of the yarn in the oven between about 0.5 and about 1.0 seconds as the maximum length decrease is reached. In a preferred process for poly(ε-caproamide) yarns, the relaxation temperature is attained by heating in an oven at a temperature between about 220° and 300° C. with residence time of the yarn in the oven between about 0.5 and about 1.0 seconds as the maximum length decrease is reached.

The process of the invention provides a commercially-feasible process in which a warp of multiple feed yarn ends can be converted to yarns with extremely high tenacity and low or moderate shrinkage. Feed yarns ranging from undrawn to "fully drawn" yarns can be used successfully in the process. When fully drawn yarns are used as feed yarns in the process, the tenacity can be increased to levels above about 11 g/d while maintaining other functional properties such as low or moderate shrinkage and high modulus. Undrawn or partially drawn feed yarns can similarly be converted to yarns with very high tenacity levels, high modulus and low or moderate shrinkages.

BRIEF DESCRIPTION OF THE DRAWING

The FIGURE is a diagrammatical view of a process useful in making preferred yarns in accordance with the present invention.

DETAILED DESCRIPTION

Polyamides useful for yarns in accordance with the invention include various linear, fiber-forming polycarbonamide homopolymers and copolymers being comprised of at least about 85% by weight of poly(hexamethylene adipamide) or poly(ε-caproamide). The polyamides have a relative viscosity of above about 50 on a formic acid basis, preferably above about 60, and are typically melt-spinnable to yield high tenacity fibers upon drawing. Preferably, the polyamide is homopolymer poly(hexamethylene adipamide) or poly(ε-caproamide), and most preferably is homopolymer poly(hexamethylene adipamide).

The tenacity of the yarns in accordance with the invention is greater than about 11 g/d when measured on a yarn basis enabling the yarns to be useful for a wide range of industrial applications including tires, hoses, belts, ropes, etc. Preferably, the yarn tenacity is greater than about 11.5 g/d. In yarns of the invention, yarn tenacities can be as high as about 13.0 g/d or more. The modulus of the yarns is above about 35 g/d, preferably is above about 40 g/d, and most preferably is above about 45 g/d. Modulus values of up to about 75 g/d or more are possible. The elongation to break is preferably above about 10%, more preferably is above about 14% and can be as high as about 30%.

The denier of the yarns will vary widely depending on the intended end use and the capacity of the equipment used to make the yarns. Typical deniers are, for example, on the order of 100–4000denier. The denier per filament (dpf) can also range widely but is generally between 1 and about 30 denier for most industrial applications, preferably between about 3 and about 7 dpf.

The dry heat shrinkage of the yarns of the invention is not more than about 6.5% at 160° C. making the yarns particularly well-suited for applications where low to moderate shrinkage is desirable. In general, it is very difficult to decrease the dry heat shrinkage below about 2% and still maintain high tenacities above 11.0%. Thus, a preferred dry heat shrinkage range is between about 2 and about 6.5%. Boil-off shrinkages are low and are less than about 7%.

The yarns of the invention have a differential birefringence, D: $\Delta_{0.90-0.00}$, of greater than 0. Differential birefringence as used herein means the difference in birefringence (Δ) between a point on the cross-section of a fiber of the yarn 0.9 of the distance from the center to the surface of the fiber ($\Delta_{0.90}$) and the center of the fiber ($\Delta_{0.00}$) It is preferable for the differential birefringence to remain at a very low level so that the surface and the core polymer of each fiber of the yarns can be drawn to essentially the same extent to maximize tensile properties. Thus, the differential birefringence should generally not be above about 0.003, preferably not above 0.002.

The combination of extremely high tenacity and low or moderate shrinkage in yarns in accordance with the invention, as well as other useful properties, are due to the novel fine structure of the fiber. The novel fine structure is characterized by a combination of properties including a crystal perfection index (CPI) greater than about 73. A long period spacing greater than about 100 Å is also characteristic of the fibers of the invention. A long period intensity (LPI) of greater than about 1.0 is observed in preferred yarns in accordance with the invention, more preferably LPI is at least 1.3. The apparent crystallite size (ACS) is greater than about 55 Å in the 100 plane for poly(hexamethylene adipamide) yarns. Yarns of the invention have a density of greater than about 1.143 g/cc. Yarns of the invention preferably have values of birefringence which are greater than about 0.06. The yarns have sonic modulus values which are greater than about 90 g/d. Orientation angles of the yarns are greater than 10 degrees, preferably greater than 12 degrees.

It is believed that the fiber fine structure functions as follows to provide the combination of extremely high tenacity, low or moderate shrinkage and high modulus. In polyamide fibers, there are at least two phases which are functionally connected in series and which are responsible for fiber properties. One of these phases is crystalline and is made up of crystals which are effectively nodes in a highly one-dimensional molecular network. Connecting the crystals are noncrystalline polymer chain segments. The concentration (i.e. number per unit cross-sectional area) and uniformity of these connector molecules determines the ultimate fiber strength.

The very high values for normalized elastic range (greater than about 0.55), normalized yield stress (greater than about 0.78) and sonic modulus (greater than about 90 g/d) indicate that the external stress on the fiber is highly uniformly distributed across the load bearing connector molecules. The levels attained for these parameters in the preferred yarns in accordance with the invention are far superior to measured values for commercially available polyamide industrial yarns.

Yarns in accordance with the invention can be produced from known polyamide yarns in a process in accordance with the invention which includes carefully controlled drawing and relaxation steps. The process is advantageously practiced using a warp of a multiplicity of feed yarn ends to improve economics relating to the production of the yarns of the invention.

As will become more apparent hereinafter, feed yarns for producing yarns of the invention can be "fully" drawn, partially drawn, or undrawn polyamide yarns. Good quality feed yarns, that is, yarns with few broken filaments with low along-end denier variability, and comprised of polymer containing little or no nonessential materials such as delusterants or large sperulites are necessary for acceptable process continuity. "Fully" drawn is intended to refer to yarns having properties corresponding to yarns which are drawn to a high tenacity level for an intended end use in a commercially-practical manufacturing process. Typical commercially-available "fully" drawn yarns suitable for use as feed yarns have a tenacity of about 8–10.5 g/d and have a birefringence of about 0.050–0.060. Partially drawn and undrawn feed yarns are typically not widely available commercially but are well-known in the art. Partially drawn yarns have been drawn to some extent but generally are not useful without further drawing. Such partially drawn yarns typically have a birefringence of about 0.015–0.030. Undrawn is intended to refer to yarn which has been spun and quenched but has not been drawn subsequently to quenching. Typically, the birefringence of undrawn yarns is on the order of about 0.008.

Referring now to the FIGURE, apparatus 10 is illustrated which can be employed in a process of the invention to make yarns in accordance with the invention from "fully" drawn, partially drawn or undrawn feed yarns. While a single end process is shown and described hereinafter, the process is directly applicable to a multiple end process in which a warp of a multiplicity of feed yarns is employed to improve economy. With reference to the FIGURE, feed yarn Y is led from a supply package 12, passed through a suitable yarn tension control element 14, and enters a draw zone identified generally by the numeral 16.

In the draw zone 16, feed yarns are drawn while being simultaneously heated in at least a final draw stage as will become more apparent hereinafter. The drawing and heating is performed until a draw tension of at least about 3.8 g/d is applied to the yarn when the yarn has been heated to the yarn draw temperature of at least about 185° C., preferably at least about 190° C. As will be discussed hereinafter, the yarn temperature for poly(ε-caproamide) in the final draw stage should not be as high as those used for poly(hexamethylene adipamide). Thus, it is preferable for poly(ε-caproamide) yarns to be drawn under a tension of at least about 4.8 g/d in the final draw stage. To achieve this, different drawing steps, differing total draw ratios and different heating patterns are used for differing feed yarns. For example, a total draw of 5.5X or more with an initial unheated draw stage may be necessary for undrawn yarns while a draw of 1.1-1.3X may be suitable for "fully" drawn yarns. Partially drawn yarns may be drawn to some intermediate ratio. In the drawing of all the feed yarn types, the tenacity during the final draw stage, if measured, generally will increase to greater than the initial tenacity of a typical "fully" drawn yarn by about 10% to 30%, i.e., to greater than about 11 g/d to about 13.0. In the final draw stage, the drawing is preferably performed in increments as the yarn is heated. Drawing can begin on heated rolls with a series of successive drawing steps. Due to the high temperatures to be reached when the draw tension is at least about 3.8 g/d, non-contact heating of the yarn is preferred, preferably in an oven.

Referring again to the FIGURE, the drawing of the yarn Y in draw zone 16 of the process illustrated begins as the yarn passes in a serpentine fashion through a first set of seven draw rolls identified collectively as 18 and individually as 18*a*-18*g*. These rolls are suitably provided by godet rolls which have the capability of being heated such as by being internally-heated by the circulation of heated oil. In addition, the rotational velocity of the rolls is controlled to impart a draw of typically 0.5% to 1% to the yarn between each successive roll in the set of rolls to draw the yarn slightly and to maintain tight contact of the yarn with the rolls. The yarn Y is pressed against the first roll 18*a* by a nip roll 20 to prevent slippage.

Yarn Y is then forwarded to a second set 22 of seven draw rolls 22*a*-22*g* which are internally heated and the rotational velocity of which is controlled similarly to the first roll set 18. Typically, the rotational velocity of the rolls is controlled to impart a draw of typically 0.5% to 1% to the yarn between each successive roll in the set of rolls as in the first roll set. The velocity difference between the first roll set 18 and the second roll set 22 (between roll 18*a* and roll 22*a*) can be varied to draw the yarn as it advances between the sets of rolls. For undrawn feed yarns, a majority of the draw, e.g., 2.5-4.5X is usually performed in an initial "space" draw area between the first and second roll sets with only moderate or no heating of the first roll set 18. For "fully" drawn feed yarns, substantially no draw is typically imparted to the yarn between the first and second roll sets 18 and 22 and the first roll set 18 can be bypassed if desired although it is useful to run the yarn through the nip of rolls 18*a* and 20 to establish positive engagement of the yarn and avoid slippage during later drawing. Partially drawn yarns generally should be drawn as needed in the space draw zone so that the overall draw experienced by the yarns after space drawing is similar to or somewhat less than "fully" drawn feed yarns. Usually, for all feed yarns types, the second roll set 22 is used to heat the yarn by conduction in preparation for the final drawing at elevated temperature, e.g., roll temperatures of typically about 150°-215° C.

After advancing past the second roll set 22, the yarn Y enters a heated draw area provided by two ovens, 24 and 26, respectively, which can be the forced hot air type with the capability to provide oven temperatures of at least about 300° C. The final draw stage which achieves the maximum draw of the process is performed in the heated draw area. The residence time and the temperature of the ovens is such that the yarn Y is heated to at least about 185° C., preferably, 190° C. but the yarn temperature cannot exceed or approach the polyamide melting point too closely. To accomplish the heating effectively, the oven temperatures may exceed the yarn temperatures by as much as 130° C. at typical process speeds. For poly(hexamethylene adipamide) yarns, preferred yarn temperatures are between about 190° and about 240° C. and the oven temperatures are preferably between about 220° and about 320° C. with a residence time of between about 0.5 and about 1.0 seconds. The melting point of poly(ε-caproamide) is lower and thus the yarn temperatures are preferably between about 190° and about 215° C. Preferred oven temperatures for poly(ε-caproamide) are between about 220° and about 300° C. with a residence time of between about 0.5 and about 1.0 seconds. The draw in the heated draw area is determined by the speed of the first roll 22*a* of the second roll set 22 and the first roll 28*a* of the third roll set 28 (seven rolls 28*a*-28*g*) through which the yarn Y advances in a serpentine fashion after leaving the ovens 24 and 26. The total draw for the process is determined by the velocity of the first roll 18*a* in the first roll set and the speed of the first roll 28*a* in the third roll set. This first roll 28*a* in the third roll set marks the end of the draw zone 16 since, unlike the first and second roll sets, the velocity of successive rolls of roll set 28 decreases by between 0.5-1.0% as the yarn advances. Thus, a relaxation zone of the process, which is identified generally by the numeral 30, begins at roll 28*a*.

In the relaxation zone 30, the yarn is relaxed (the tension is decreased in a controlled fashion and the yarn is allowed to decrease in length) by between about 2 and about 13.5%, preferably between about 2 and about 10%. The yarn is heated during the relaxation so that a final yarn relaxation temperature of above about 185° C., preferably at least about 190° C. is reached. To assist in maintaining high yarn tenacity and modulus during relaxation, a tension of above about 0.4 g/d. should be maintained on the yarn.

The relaxation is preferably performed in increments as the yarn is relaxed. The initial relaxation can be performed on heated rolls and advantageously is a series of successive relaxation steps within the initial relaxation increment. Due to the high temperatures necessary during the final relaxation increment, non-contact heating of the yarn in an oven is preferred.

As illustrated in the FIGURE, the relaxation is performed initially by the incremental relaxation on the third roll set 28 which is heated to about 150°-215° C. The yarn then passes through relaxation ovens 32 and 34 capable of providing oven temperatures of at least about 300° C. Achieving the necessary final relaxation temperature depends on the oven temperature and residence time of the yarn in the ovens. Preferably, the ovens contain air at temperatures in excess of the yarn temperature by as much as about 130° C. for effective heating at reasonable process speeds. For poly(hexamethylene adipamide) yarns, preferred yarn temperatures are between about 190° and about 240° C. and the oven temperatures are preferably between about 220° and about 320° C. with a residence time of between about 0.5 and about 1.0 seconds. The melting point of poly(ε-caproamide) is lower and thus the yarn temperatures are preferably between about 190° and about 215° C. Preferred oven temperatures for poly(ε-caproamide) are between about 220° and about 300° C. with a residence time of between about 0.5 and about 1.0 seconds.

After the yarn passes through the ovens 32 and 34, yarn Y then passes through a fourth roll set 36 of 3 rolls (36*a*-36*c*) in a serpentine fashion with the yarn Y being pressed against the last roll 36*c* by nip roll 38 to prevent slippage. The surfaces of the fourth roll set 36 can be internally cooled with chilled water to assist in reducing the yarn temperature to a level suitable for windup. The yarn is retensioned slightly on roll 36*c* in order to produce a stable running yarn and avoid wraps on roll 36*b*. The total relaxation is thus determined by the velocity difference between the first roll 28*a* of the third roll set 28 and the first roll 36*a* of the fourth roll set 36.

After leaving the relaxation zone 30 of the process, the yarn Y is fed through a yarn surface treatment zone 40 which can include an interlace jet (not shown) to commingle the yarn filaments, a finish applicator 42 to apply a yarn finish or other treatments to the yarn. At a wind-up station (not shown), the multiple ends of yarn Y are wound up onto suitable packages for shipping and end use.

In a process in accordance with the invention using apparatus as illustrated for a warp of multiple ends, preferred wind-up speeds are from 150 mpm to 750 mpm.

The following examples illustrate the invention and are not intended to be limiting. Yarn properties were measured in accordance with the following test methods. Percentages are by weight unless otherwise indicated.

TEST METHODS

Conditioning: Packaged yarns were conditioned before testing for at least 2 hours in a 55% ±2% relative humidity, 74° F. ±2° F. (23° C. ±1° C.) atmosphere and measured under similar conditions unless otherwise indicated.

Relative Viscosity: Relative viscosity refers to the ratio of solution and solvent viscosities measured in a capillary viscometer at 25° C. The solvent is formic acid containing 10% by weight of water. The solution is 8.4% by weight polyamide polymer dissolved in the solvent.

Denier: Denier or linear density is the weight in grams of 9000 meters of yarn. Denier is measured by forwarding a known length of yarn, usually 45 meters, from a multifilament yarn package to a denier reel and weighing on a balance to an accuracy of 0.001 g. The denier is then calculated from the measured weight of the 45 meter length.

Tensile Properties: Tensile properties (Tenacity, Elongation at break and Modulus) are measured as described by Li in U.S. Pat. No. 4,521,484 at col. 2, 1.61 to col. 3, 1. 6, the disclosure of which is hereby incorporated by reference.

Initial modulus is determined from the slope of a line drawn tangential to the "initial" straightline portion of the stress strain curve. The "initial" straightline portion is defined as the straightline portion starting at 0.5% of full scale load. For example, full scale load is 50.0 pounds for 600–1400 denier yarns; therefore the "initial" straightline portion of the stress-strain curve would start at 0.25 lbs. Full scale load is 100 pounds for 1800–2000 denier yarns and the initial straightline portion of the curve would start at 0.50 lbs.

Dry Heat Shrinkage: Dry heat shrinkage is measured on a Testrite shrinkage instrument manufactured by Testrite Ltd. Halifax, England A ~24" (61 cm) length of multifilament yarn is inserted into the Testrite and the shrinkage recorded after 2 minutes at 160° C. under a 0.05 g/d load. Initial and final lengths are determined under the 0.05 g/d load. Final length is measured while the yarn is at 160° C.

Boil-off Shrinkage: After stripping the surface yarn off a yarn package and discarding, one meter samples of yarn are conditioned relaxed for between 14 and 24 hours at 55% RH and 75° F. Each sample is then tied into a loop and its original length determined under a 1.0g./tex (0.111 g/denier) load. The samples are placed in a cheesecloth bag and then into a bath of boiling water for 30 minutes. After removing the samples from the bath, they are centrifuged. The loop samples are then removed from the cheesecloth bags, dried in a forced air oven at 65° C. for one hour, and reconditioned at 55% RH/75° F./4–24 hrs. The final sample length is determined under a 1.0 g./tex load.

$$\% \text{ Shrinkage} = \frac{L - F}{L} \times 100$$

Where
L = original loop length.
F = final loop length.

BIREFRINGENCE AND DIFFERENTIAL BIREFRINGENCE

The optical parameters of the fibers of this invention are measured according to the method described in Frankfort and Knox U.S. Pat. No. 4,134,882 beginning at column 9, line 59 and ending at column 10, line 65, the disclosure of which is incorporated by reference, with the following exceptions and additions. First, instead of Polaroid T-410 film and 1000X image magnification, high speed 35mm film intended for recording oscilloscope traces and 300X magnification are used to record the interference patterns. Also suitable electronic image analysis methods which give the same result can also be used. Second, the word "than" in column 10, line 26 is replaced by the word "and" to correct a typographical error.

Because the fibers of this invention are different from those of 4,134,882, a different parameter, calculated from the same n|| and n⊥ distributions at +0.05 ...+0.95 of the distance from center to edge of the fiber image, is needed to characterize them. Here the + refers to opposite sides from the center of the fiber image. The birefringence Δ at each point (i) [where i goes from −0.95 to +0.95] in the image is determined the same way as in the reference. In this case the desired structure parameter is the difference in Δ between the center of the image and the point 0.90 of the distance from the center to the edge. The birefringence at the center of the image for any filament $\Delta(0.00)$ is defined as the average of the birefringence at the two points corresponding with $i=\pm 0.05$:

$$\Delta(0.00)=(\Delta(-0.05)+\Delta(0.05)0/2$$

Similarly, for either side of the image corresponding with $i=\pm 0.90$, the birefringence $\Delta(\pm 0.90)$ is defined by:

$\Delta(\pm 0.90)=(\Delta(\pm 0.95)+\Delta(\pm 0.85))/2$, where the plus sign is used for one side of the image and the minus sign for the other.

The differential birefringence $D{:}\Delta_{0.90-0.00}$ is then defined by:

$$D{:}\Delta_{0.90-0.00} = [\Delta(+0.90)+\Delta(-0.90)]/2-\Delta(0.00)$$

X-RAY PARAMETERS

Crystal Perfection Index and Apparent

Crystallite Size: Crystal perfection index and apparent crystallite size are derived from X-ray diffraction scans. The diffraction pattern of fibers of these compositions is characterized by two prominent equatorial X-ray reflections with peaks occurring at scattering angle approximately 20°-21° and 23° $2\theta$.

X-ray diffraction patterns of these fibers are obtained with an X-ray diffractometer (Philips Electronic Instruments, Mahwah, N.J., cat. no. PW1075/00) in reflection mode, using a diffracted-beam mono-chromator and a scintillation detector. Intensity data are measured with a rate meter and recorded by a computerized data collection/reduction system. Diffraction patterns are obtained using the instrumental settings:

Scanning Speed 1° $2\theta$per minute;
Stepping Increment 0.025° $2\theta$;
Scan Range 6° to 38° , $2\theta$; and
Pulse Height Analyzer, "Differential".

For both Crystal Perfection Index and Apparent Crystallite Size measurements, the diffraction data are processed by a computer program that smoothes the data, determines the baseline, and measures peak locations and heights.

The X-ray diffraction measurement of crystallinity in 66 nylon, 6 nylon, and copolymers of 66 and 6 nylon is the Crystal Perfection Index (CPI) (as taught by P. F. Dismore and W. O. Statton, J. Polym. Sci. Part C, No. 13, pp. 133-148, 1966). The positions of the two peaks at 21° and 23° $2\theta$ are observed to shift; as the crystallinity increases, the peaks shift farther apart and approach the positions corresponding to the "ideal" positions based on the Bunn-Garner 66 nylon structure. This shift in peak location provides the basis of the measurement of Crystal Perfection in 66 nylon:

$$CPI = \frac{[d(\text{outer})/d(\text{inner})] - 1}{0.189} 100$$

where d(outer) and d(inner) are the Bragg 'd' spacings for the peaks at 23° and 21° respectively, and the denominator 0.189 is the value for d(100)/d(010) for well-crystallized 66 nylon as reported by Bunn and Garner (Proc. Royal Soc.(London), A189, 39, 1947). An equivalent and more useful equation, based on 8 values, is:

$$CPI=[2\theta(\text{outer})/2\theta(\text{inner})-1]\times 546.7$$

Because 6 nylon has a different crystallographic unit cell, the factor for well-crystallized 6 nylon is different, and the equation is:

$$CPI=[2\theta(\text{outer})/2\theta H(\text{inner})-1]\times 509.8$$

Apparent Crystallite Size: Apparent crystallite size is calculated from measurements of the half-height peak width of the equatorial diffraction peaks. Because the two equatorial peaks overlap, the measurement of the half-height peak width is based on the half-width at half-height. For the 20°-21° peak, the position of the half-maximum peak height is calculated and the $2\theta$ value for this intensity is measured on the low angle side. The difference between this $2\theta$ value and the $2\theta$ value at maximum peak height is multiplied by two to give the half-height peak (or "line") width. For the 23° peak, the position of the half-maximum peak height is calculated and the $2\theta$ value for this intensity is measured on the high angle side; the difference between this $2\theta$ value and the $2\theta$ value at maximum peak height is multiplied by two to give the half-height peak width.

In this measurement, correction is made only for instrumental broadening; all other broadening effects are assumed to be a result of crystallite size. If 'B' is the measured line width of the sample, the corrected line width 'beta ' is $$\beta = \sqrt{B^2 - b^2}$$

where 'b' is the instrumental broadening constant. 'b' is determined by measuring the line width of the peak located at approximately 28° $2\theta$ in the diffraction pattern of a silicon crystal powder sample.

The Apparent Crystallite Size (ACS) is given by $ACS=(K\lambda)/(\beta\cos\theta)$, wherein K is taken as one (unity);
$\lambda$ is the X-ray wavelength (here 1.5418 Å);
$\beta$ is the corrected line breadth in radians; and
$\theta$ is half the Bragg angle (half of the $\theta$ value of the selected peak, as obtained from the diffraction pattern).

X-ray Orientation Angle: A bundle of filaments about 0.5 mm in diameter is wrapped on a sample holder with care to keep the filaments essentially parallel. The filaments in the filled sample holder are exposed to an X-ray beam produced by a Philips X-ray generator (Model 12045B) available from Philips Electronic Instruments. The diffraction pattern from the sample filaments is recorded on Kodak DEF Diagnostic Direct Exposure X-ray film (Catalogue Number 154-2463), in a Warhus pinhole camera. Collimators in the camera are 0.64 mm in diameter. The exposure is continued for about fifteen to thirty minutes (or generally long enough so that the diffraction feature to be measured is recorded at an Optical Density of ~1.0). A digitized image of the diffraction pattern is recorded with a video camera. Transmitted intensities are calibrated using black and white references, and gray level (0-255) is converted into optical density. The diffraction pattern of 66 nylon, 6 nylon, and copolymers of 66 and 6 nylon has two prominent equatorial reflections at $2\theta$ approximately 20°-21° and 23°; the outer (~23°) reflection is used for the measurement of Orientation Angle. A data array equivalent to an azimuthal trace through the two selected equatorial peaks (i.e. the outer reflection on each side of the pattern) is created by interpolation from the digital image data file; the array is constructed so that one data point equals one-third of one degree in arc.

The Orientation Angle (OA) is taken to be the arc length in degrees at the half-maximum optical density (angle subtending points of 50 percent of maximum density) of the equatorial peaks, corrected for background. This is computed from the number of data points between the half-height points on each said of the peak (with interpolation being used, this is not an integral number). Both peaks are measured and the Orientation Angle is taken as the average of the two measurements.

Long Period Spacing and Normalized Long Period Intensity: The long period spacing (LPS), and long period intensity (LPI), are measured with a Kratky small angle diffractometer manufactured by Anton Paar K.G., Graz, Austria. The diffractometer is installed at a line-focus port of a Philips XRG3100 x-ray generator equipped with a long fine focus X-ray tube operated at 45KV and 40ma. The X-ray focal spot is viewed at a 6 degree take-off angle and the beam width is defined with a 120 micrometer entrance slit. The copper K-alpha radiation from the X-ray tube is filtered with a 0.7 mil nickel filter and is detected with a NaI(TI) Scintillation counter equipped with a pulse height analyzer set to pass 90% of the CuK-alpha radiation symmetrically.

The nylon samples are prepared by winding the fibers parallel to each other about a holder containing a 2 cm diameter hole. The area covered by the fibers is about 2 cm by 2.5 cm and a typical sample contains about 1 gram nylon. The actual amount of sample is determined by measuring the attenuation by the sample of a strong CuK-alpha X-ray signal and adjusting the thickness of the sample until the transmission of the X-ray beam is near 1/e or 0.3678. To measure the transmission, a strong scatterer is put in the diffracting position and the nylon sample is inserted in front of it, immediately beyond the beam defining slits. If the measured intensity without attenuation is Io and the attenuated intensity is I, then the transmission T is I/(Io). A sample with a transmission of 1/e has an optimum thickness since the diffracted intensity from a sample of greater or less thickness than optimum will be less than that from a sample of optimum thickness.

The nylon sample is mounted such that the fiber axis is perpendicular to the beam length (or parallel to the direction of travel of the detector). For a Kratky diffractometer viewing a horizontal line focus, the fiber axis is perpendicular to the table top. A scan of 180 points is collected between 0.1 and 4.0 degrees $2\theta$, as follows: 81 points with step size 0.0125 degrees between 0.1 and 1.1 degrees; 80 points with step size 0.025 degrees between 1.1 and 3.1 degrees; 19 points with step size 0.05 degrees between 3.1 and 4.0 degrees. The time for each scan is 1 hour and the counting time for each point is 20 seconds. The resulting data are smoothed with a moving parabolic window and the instrumental background is subtracted. The instrumental background, i.e. the scan obtained in the absence of a sample, is multiplied by the transmission, T, and subtracted, point by point, from the scan obtained from the sample. The data points of the scan are then corrected for sample thickness by multiplying by a correction factor, $CF=-1.0/(eT\ln(T))$. Here e is the base of the natural logarithm and ln(T) is the natural logarithm of T. Since T is less than 1, ln (T) is always negative and CF is positive. Also, if $T-1/e$, then $CF=1$ for the sample of optimum thickness. Therefore, CF is always greater than 1 and corrects the intensity from a sample of other than optimum thickness to the intensity that would have been observed had the thickness been optimum. For sample thicknesses reasonably close to optimum, CF can generally be maintained to less than 1.01 so that the correction for sample thickness can be maintained to less than a percent which is within the uncertainly imposed by the counting statistics.

The measured intensities arise from reflections whose diffraction vectors are parallel to the fiber axis. For most nylon fibers, a reflection is observed in the vicinity of 1 degree $2\theta$. To determine the precise position and intensity of this reflection, a background line is first drawn underneath the peak, tangent to the diffraction curve at angles both higher and lower than the peak itself. A line parallel to the tangent background line is then drawn tangent to the peak near its apparent maximum but generally at a slightly higher $2\theta$ value. The $2\theta$ value at this point of tangency is taken to be the position since it is position of the maximum if the sample background were subtracted. The long period spacing, LPS, is calculated from the Bragg Law using the peak position thus derived. For small angles this reduces to:

$$LPS=\lambda/\sin(2\theta)$$

The intensity of the peak, LPI, is defined as the vertical distance, in counts per second, between the point of tangency of the curve and the background line beneath it.

The Kratky diffractometer is a single beam instrument and measured intensities are arbitrary until standardized. The measured intensities may vary from instrument to instrument and with time for a given instrument because of x-ray tube aging, variation in alignment, drift, and deterioration of the scintillation crystal. For quantitative comparison among samples, measured intensities were normalized by rationing with a stable, standard reference sample. This reference was chosen to be a "fully drawn" nylon 66 identified as T-717 and commercially available from E. I. du Pont de Nemours and Company, Wilmington, Del.

Sonic Modulus: Sonic Modulus is measured as reported in Pacofsky U.S. Pat. No. 3,748,844 at col. 5, lines 17 to 38, the disclosure of which is incorporated by reference except that the fibers are conditioned for 24 hours at 70° F. (21° C.) and 65% relative humidity prior to the test and the nylon fibers are run at a tension of 0.1 grams per denier rather than the 0.5–0.7 reported for the polyester fibers of the referenced patent.

Density: Density of the polyamide fiber is measured by use of the density gradient column technique described in ASTM DC150556-68 using carbon tetrachloride and heptane liquids at 25° C.

Tension: While the process is running, tension measurements are made in the draw and relax zones (in the FIGURE, after over 26 in the draw zone and after oven 34 in the relaxation zone about 12 inches (30 cm) from the exits of the ovens) using model Checkline DXX-40, DXX-500, DXX-1K and DXX-2K hand-held tensiometers manufactured by Electromatic Equipment Company, Inc., Cedarhurst, N.Y. 11516.

Yarn Temperature: Yarn Temperatures are measured after the yarn leaves draw oven 26 and relaxation oven 34 with the measurement made about 4 inches (10 cm) away from the oven exit. The measurements are made with a non-contact infrared temperature measurement system comprised of an infrared optical scanning system with a 7.9 micron filter (band pass of about 0.5 microns) and broad band detector to sense the running yarn and a temperature reference blackbody placed behind the yarn which can be precisely heated to temperatures up to 300° C. A type J thermocouple, buried in the reference, is use with a Fluke Model 217A digital indicator traceable to National Bureau Standards to measure the reference temperature. Highly accurate measurement of the temperature of polyamide yarn is obtained since the 7.9 micron filter corresponds to an absorption band where the emissivity is known to be close to unity. In practice, the temperature of the reference is adjusted so that the yarn line scan image disappears as viewed on an oscilloscope and, at this null point, the yarn will be at the same temperature as the reference.

Normalized Elastic Range and Normalized Yield Stress: To characterize structural strength, cohesion, elasticity, and stiffness of fiber building blocks in high quality yarns, the Normalized Elastic range and Normalized Yield Stress are measured from high speed stress-strain curves of single filaments, selected at random from a yarn sample.

The Elastic Range is determined from the stress-strain traces as the range of stress over the linear portion of the trace, between the initial and secondary points of deflection—the latter designated as yield points.

This region of linearity is defined as the segment of the stress-strain trace with a constant slope, between the stress hardening point, where the slope of the trace begins to increase due to successive engagement of more load-bearing structural fiber elements, and the yield point where they begin to disengage or fail. The end points of this segment are easily defined as the points where the recorded trace of the line segment deviates, by ~1% of the break stress, from a tangent straight line—drawn with a fine pen or pencil, in width not exceeding that of the recorded trace.

The Elastic Range is calculated as the stress difference between these two points. The Normalized Elastic Range is calculated as a dimension-less fraction (Elastic Range divided by the breaking stress of the filament). This avoids any uncertainties due to denier variance and denier errors.

{The breaking stress is defined as the maximum stress recorded before the abrupt (or gradual) downturn of the recorded stress-strain plot. Tenacity is defined as the ratio of break stress divided by denier.}

The Yield Stress is defined by the stress at the upper end point of this Elastic Range (=linear portion of the stress-strain trace cited above) signifying beginning plastic flow prior to break. The Normalized Yield Stress is calculated as the Yield Stress divided by the break stress of the filament, giving again a dimensionless ratio, which characterizes the mechanical fiber structures and the quality of their connections.

All samples were run on an Instron tensile tester with 0.5 inch gauge length and 833%/min. elongation rate. The samples were conditioned for 24 hrs. at 70° F. and 65% RH prior to measurement. To achieve the required precision, at least 10 good breaks, preferably 20, are made and recorded. Measurements are made on all good traces—eliminating jaw breaks, obvious slippage, etc.—and the averaged values of Elastic Range, Yield Stress, Normalized Elastic Range and Normalized Yield Stress are reported.

EXAMPLE 1

A fully drawn 848 denier 140 filament yarn with a formic acid relative viscosity of about 67 was prepared by continuous polymerization and extrusion of poly(-hexamethylene adipamide) and drawn using the process of Good, U.S. Pat. No. 3,311,691. This fully drawn yarn with 9.6 gpd tenacity and 8.8% shrinkage (Feed Yarn 1) is more fully described in Table 2.

Using apparatus as illustrated in the FIGURE operated using the process conditions listed in Table 1, the yarn was taken off a feed package 12 over end, forwarded to the tension control element 14 for tension control, and then nipped by nip roll 20 and godet roll 18*a* of roll set 18. The godet rolls 18*b* through 18*g* of roll set 18 were bypassed and the yarn was forwarded directly to godet rolls 22*a*-22*g* of roll set 22, through ovens 24 and 26 to roll set 28. The draw tension after over 26 was 4.69 g/d at a yarn temperature of 233° C. The yarn then passes through all seven rolls of roll set 28, through ovens 32 and 34, and through the rolls of roll set 36 before wind-up. The yarn temperature of the yarn emerging from relaxation oven 34 was 240° C. and the relaxation percentage was 8.7%. Incremental draws of 0.5% were used between each pair of rolls in roll set 22 and incremental relaxations of 0.5% were used between each pair of rolls in the third roll set 28. A detailed list of process parameters including roll speeds and oven and roll temperatures is provided in Table 1.

The yarn thus obtained had a tenacity, dry heat shrinkage, and modulus balance of 11.2 g/d, 2.9%, and 46.3 g/d, respectively. The connector molecules in the fiber are uniformly distributed to better support external stresses as evidenced by 0.64 normalized elastic range and 0.87 normalized yield stress. This high tenacity product combined with excellent dimensional stability results from a combination of structural parameters including high 0.0622 birefringence and 95.1 gpd sonic modulus. A complete list of properties are shown in Table 2.

EXAMPLE 2

A fully drawn 1260 denier 210 filament yarn with formic acid relative viscosity of about 67 was prepared by continuous polymerization and extrusion of polyhexamethylene adipamide and drawn using the process of Good, U.S. Pat. No. 3,311,691. This fully drawn yarn with 9.7 gpd tenacity and 7.7% shrinkage (Feed Yarn 2) is more fully described in Table 2.

Feed yarn 2 was then drawn and relaxed as in Example 1 using the apparatus illustrated in the FIGURE and the conditions described in Table 1. The draw tension was 4.05 g/d at a yarn temperature of 219° C. The temperature of the yarn emerging from relaxation oven 34 was 219° C. and the relaxation percentage was 8.6%. The process speeds and roll and oven temperatures and other parameters are shown in Table 1.

The yarn thus obtained had a tenacity and dry heat shrinkage balance of 11.6 g/d and 3.2%, respectively. The connector molecules in the fiber are uniformly distributed to better support external stresses as evidenced by 0.61 normalized elastic range and 0.82 normalized yield stress. This high tenacity product combined with excellent dimensional stability results from a combination of structural parameters including high 0.0623 birefringence and 94.3 g/d sonic modulus. A complete list of properties are shown in Table 2.

EXAMPLE 3

A fully drawn 1260 densier 210 filament yarn with formic acid relative viscosity of about 89 was prepared by continuous polymerization and extrusion of polyhexamethylene adipamide and drawn using the process of Good, U.S. Pat. No. 3,311,691. This fully drawn yarn with 10.0 gpd tenacity and 7.6% shrinkage (Feed Yarn 3) is more fully described in Table 2.

Feed yarn 3 was then drawn and relaxed as in Example 1 using the apparatus illustrated in the FIGURE and the conditions described in Table 1. The drawn tension was 5.27 b/d at a yarn temperature of 212° C. The temperature of the yarn emerging from relaxation oven 34 was 219° C. and the a relaxation percentage was 7.4. The process speeds, roll and oven temperatures and other process parameters are shown in Table 1.

The yarn thus obtained had a tenacity, dry heat shrinkage and modulus balance of 12.1 gpd, 5.2%, and 52.8 g/d, respectively. The connector molecules in the fiber are uniformly distributed to better support external stresses as evidenced by 0.71 normalized elastic range and 0.90 normalized yield stress. This high tenacity product combined with good dimensional stability results from a combination of structural parameters including high 0.0622 birefringence and 95.1 g/d sonic modulus. A complete list of properties are shown in Table 2.

EXAMPLE 4

The feed yarn for example 4 was the same as that described in Example 3. A sample of feed yarn 3 was drawn and relaxed as in Example 1 using the apparatus illustrated in the FIGURE and the conditions described in Table 1. The draw tension was 4.98 g/d at a yarn temperature of 212° C. The temperature of the yarn emerging from relaxation oven 34 was 219° C. and the relaxation percentage was 13.3%.

The process speeds, roll and oven temperatures and other process parameters are shown in Table 1.

The yarn thus obtained had a tenacity, dry heat shrinkage, and modulus balance of 11.1 g/d, 2.0%, and 41.2 g/d, respectively. The connector molecules in the fiber are uniformly distributed to better support external stresses as evidenced by 0.62 normalized elastic range and 0.82 normalized yield stress. This high tenacity product combined with excellent dimensional stability results from a combination of structural parameters including high 0.0605 birefringence and 92.5 g/d sonic modulus. A complete list of properties are shown in Table 2.

EXAMPLE 5

A direct spun 4000 denier 140 filament yarn with a formic acid relative viscosity of 64 was prepared by continuous polymerization and extrusion of poly(hexamethylene adipamide). After extrusion the yarn was quenched, treated with an oiling agent and wound up directly at 440 ypm. The birefringence of the spun yarn was about 0.008 . The yarn was subsequently stored at 65% RH for 48 hours to achieve near equilibrium moisture content of about 4.5%. The yarn was taken off the feed package 12 over end and forwarded to friction element 14 for tension control at 65 g. The yarn was drawn 3.28X between godet roll 18*a* of draw roll set 18 and godet roll 22*a* of draw roll set 22 and drawn 1.798X between godet roll 22*g* of draw roll set 22 and godet roll 28*a* of roll set 28. The yarn temperature after oven 26 was 226° C. The yarn was relaxed at 2.6% between godet roll 28*g* of roll set 28 and godet rolls 36*a* of roll set 36. Incremental draws of 0.5% were used between each pair of rolls in draw roll sets 18 and 22 and incremental relaxations of 0.5% were used between each pair of rolls in roll set 28. The temperature of the yarn emerging from relaxation oven 34 was 226° C. and the relaxation was 2.6%. The yarn was wound up to 120 g winding tension. The process conditions are given in Table 1.

The yarn thus obtained had a tenacity, dry heat shrinkage and modulus balance of 12 g/d, 6.5% and 75.4 g/d, respectively. The connector molecules in the fiber are uniformly distributed to better support external stresses as evidenced by 0.68 normalized elastic range and 0.87 normalized yield stress. This high tenacity product combined with good dimensional stability results from a combination of structural parameters including high 0.0639 birefringence and 103.7 g/d sonic modulus. A complete list of properties are shown in Table 2.

EXAMPLE 6

The feed yarn for Example 6 was the same as that described in Example 3. A sample of feed yarn 3 was drawn and relaxed as in Example 1 using the apparatus illustrated in the FIGURE and the conditions described in Table 1. The draw tension was 6.26 g/d at a yarn temperature of 212° C. The temperature of the yarn emerging from relaxation oven 34 was 219° C. and the relaxation percentage was 5.6%. The process speeds, roll and oven temperatures and other process parameters are shown in Table 1.

The yarn thus obtained had a tenacity, dry heat shrinkage, and modulus balance of 12.1 g/d, 6.0%, and 58 g/d, respectively. The connector molecules in the fiber are uniformly distributed to better support external stresses as evidenced by 0.73 normalized elastic range and 0.90 normalized yield stress. This high tenacity product combined with good dimensional stability results from a combination of structural parameters including high 0.0606 birefringence and 92.9 g/d sonic modulus. A complete list of properties are shown in Table 2.

TABLE 1

PROCESS CONDITIONS

| Ex. | Roll 18a Speed (mpm) | Roll 18g Speed (mpm) | Roll 22a Speed (mpm) | Roll 22g Speed (mpm) | Roll 28a Speed (mpm) | Roll 28g Speed (mpm) | Roll 36a Speed (mpm) | Roll 36c Speed (mpm) | 18a-18c Temp. (°C.) | 18d-18g Temp. (°C.) | 22a-22c Temp. (°C.) | 22d-22g Temp. (°C.) |
|---|---|---|---|---|---|---|---|---|---|---|---|---|
| 1 | 328.8 | — | 327.0 | 336.8 | 399.4 | 386.7 | 364.7 | 366.4 | — | — | 150 | 175 |
| 2 | 347.3 | — | 349.7 | 361.2 | 398.2 | 387.0 | 364.0 | 366.5 | — | — | 150 | 175 |
| 3 | 345.2 | — | 345.9 | 357.2 | 398.2 | 384.7 | 368.7 | 371.1 | — | — | 150 | 175 |
| 4 | 345.2 | — | 345.9 | 357.2 | 398.2 | 384.7 | 345.1 | 348.2 | — | — | 150 | 175 |
| 5 | 67.4 | 69.6 | 221.1 | 228.2 | 397.5 | 385.9 | 387.3 | 390.5 | 33.4 | 33.3 | 150 | 175 |
| 6 | 345.2 | — | 345.5 | 356.8 | 397.6 | 386.3 | 375.3 | 379.2 | — | — | 150 | 175 |

28a-28c 28d-28g 36a-36c Oven 24 Oven 26 Oven 32 Oven 34

TABLE 1-continued

PROCESS CONDITIONS

| Ex. | Temp. (°C.) | Temp. (°C.) | Temp. (°C.) | Temp. (°C.) | Temp. (°C.) | Temp. (°C.) | Temp. (°C.) | 18a-22a Draw Ratio | 22a-28a Draw Ratio | 18a-28a Draw Ratio |
|---|---|---|---|---|---|---|---|---|---|---|
| 1 | 200 | 200 | 27.1 | 290 | 290 | 300 | 300 | 0.995 | 1.221 | 1.215 |
| 2 | 200 | 200 | 27.0 | 290 | 290 | 290 | 290 | 1.007 | 1.139 | 1.147 |
| 3 | 200 | 200 | 28.0 | 280 | 280 | 290 | 290 | 1.002 | 1.151 | 1.154 |
| 4 | 200 | 200 | 28.0 | 280 | 280 | 290 | 290 | 1.002 | 1.151 | 1.154 |
| 5 | 200 | 200 | 26.3 | 2.80 | 2.80 | 2.80 | 2.80 | 3.280 | 1.798 | 5.898 |
| 6 | 200 | 200 | 25.0 | 280 | 280 | 290 | 290 | 1.001 | 1.151 | 1.152 |

| Ex. | 28a-36a Relaxation (%) | Ovens 24 & 26 Residence Time (sec.) | After Oven 26 Yarn Temp. (°C.) | After Oven 26 Tension (g/d) | Ovens 32 & 34 Residence Time (sec.) | Wind Up After Oven 34 Yarn Temp. (°C.) | Wind Up After Oven 34 Tension (g/d) | Wind Up Tension (g) |
|---|---|---|---|---|---|---|---|---|
| 1 | 8.7 | 0.9 | 233 | 4.69 | 0.9 | 240 | .56 | 125 |
| 2 | 8.6 | 0.9 | 219 | 4.05 | 0.9 | 219 | .62 | 125 |
| 3 | 7.4 | 0.9 | 212 | 5.27 | 0.9 | 219 | .93 | 125 |
| 4 | 13.3 | 0.9 | 212 | 4.98 | 0.9 | 219 | .52 | 125 |
| 5 | 2.6 | 0.9 | 226 | — | 0.9 | 226 | 1.79 | 120 |
| 6 | 5.6 | 0.9 | 212 | 6.26 | 0.9 | 219 | 1.34 | 125 |

TABLE 2

YARN PROPERTIES

| Example | RV | Filament Count | Denier | Modulus (g/d) | Tenacity (g/d) | Elongation (%) | Dry Heat Shrinkage (%) @ 160° C. | Biref. | CPI | ACS (Å) 100 Pl. | ACS (Å) 010 Pl. |
|---|---|---|---|---|---|---|---|---|---|---|---|
| 1 | 67 | 140 | 750 | 46.3 | 11.2 | 19.6 | 2.9 | 0.0622 | 81.4 | 63.3 | 37.3 |
| 2 | 67 | 210 | 1206 | — | 11.6 | 16.7 | 3.2 | 0.0623 | 75.7 | 55.9 | 34.6 |
| 3 | 89 | 210 | 1214 | 52.8 | 12.1 | 15.4 | 5.2 | 0.0622 | 76.0 | 58.5 | 34.9 |
| 4 | 89 | 210 | 1284 | 41.2 | 11.1 | 21.7 | 2.0 | 0.0605 | 80.5 | 61.1 | 36.9 |
| 5 | 64 | 140 | 698 | 75.4 | 12.0 | 11.3 | 6.5 | 0.0639 | 78.7 | 63.5 | 37.7 |
| 6 | 89 | 210 | 1189 | 58.0 | 12.1 | 14.2 | 6.0 | 0.0606 | 75.4 | 58.8 | 35.4 |
| Feed 1 | 67 | 140 | 848 | 46.9 | 9.6 | 17.0 | 8.8 | 0.0591 | 64.1 | 52.6 | 28.5 |
| Feed 2 | 67 | 210 | 1260 | 49.8 | 9.7 | 19.4 | 7.7 | 0.0614 | 74.9 | 58.3 | 32.5 |
| Feed 3 | 89 | 210 | 1260 | 33.0 | 10.0 | 27.8 | 7.6 | 0.0619 | 78.5 | 61.1 | 33.4 |

| Example | Boil-off Shrink. (%) | LPS (Å) | LPI | Density (g/cc) | Sonic Modulus (g/d) | Differential Biref. | Normalized Elastic Range | Normalized Yield Stress | Orientation Angle (Deg.). |
|---|---|---|---|---|---|---|---|---|---|
| 1 | — | 112 | 2.3 | 1.1534 | 95.1 | 0.0010 | 0.64 | 0.87 | 13.8 |
| 2 | — | 104 | 1.6 | 1.1434 | 94.3 | 0.0004 | 0.61 | 0.82 | 16.3 |
| 3 | — | 110 | 1.3 | 1.1467 | 95.1 | 0.0019 | 0.71 | 0.90 | 13.8 |
| 4 | 4.0 | 112 | 2.3 | 1.1467 | 92.5 | 0.0015 | 0.62 | 0.82 | 15.2 |
| 5 | 6.1 | 112 | 1.8 | 1.1448 | 103.7 | 0.0004 | 0.68 | 0.87 | 12.3 |
| 6 | 6.8 | 113 | 1.3 | 1.1504 | 92.9 | 0.0018 | 0.73 | 0.90 | 12.4 |
| Feed 1 | — | 100 | 0.9 | 1.1401 | 75.7 | — | — | — | 14.5 |
| Feed 2 | — | 104 | 1.7 | 1.1445 | 86.4 | — | 0.36 | 0.70 | 12.7 |
| Feed 3 | — | 108 | 1.6 | 1.1445 | 88.4 | — | 0.33 | 0.65 | 13.7 |

We claim:

1. A polyamide yarn comprised of a polyamide having a relative viscosity of greater than about 50 wherein relative viscosity is determined at 25° C. 8.4% solution of polyamide from said yarn in formic acid containing 10% water, said polyamide comprising at least about 85% by weight of a polyamide selected from the class consisting of poly(hexamethylene adipamide) and poly(ε-caproamide), said yarn having a tenacity of greater than about 11.0 g/d, a dry heat shrinkage at 160° C. of not more than about 6.5%, a boil-off shrinkage of less than about 7%, a tensile modulus of at least about 35 g/d, a birefringence of greater than about 0.060, a differential birefringence, D:$\Delta_{0.90-0.00}$, of greater than 0 wherein differential birefringence is the difference between the birefringence at a point 90% of the distance from the center to the surface of the fiber and the birefringence at the center of the fiber, and a sonic modulus of greater than about 90 g/d wherein sonic modulus is calculated from the formula $E=11.3(C^2)$ in which C is the measured velocity of sound in the fiber in kilometers per second and E is the sonic modulus with units of grams per denier.

2. The yarn of claim 1 having a tensile modulus of greater than about 40 g/d.

3. The yarn of claim 2 having a tensile modulus of greater than about 45 g/d.

4. The yarn of claim 1 having a long period spacing of greater than about 100 Å wherein long period spacing is calculated from $\lambda/\sin(2\theta)$ where $\lambda$ is the wavelength of the radiation source and $\theta$ is the scattering angle.

5. The yarn of claim 1 wherein said tenacity is greater than about 11.5 g/d.

6. The yarn of claim 1 having a crystal perfection index of greater than about 73 wherein crystal perfection index is measured by X-ray diffraction and is related to the ratio of the angular positions of diffraction peaks appearing near 21 and 23 degrees, respectively, to corresponding values for well-crystallized nylon 66 and nylon 6.

7. The yarn of claim 1 having an elongation to break of at least about 10%.

8. The yarn of claim 1 having an elongation to break of at least about 14%.

9. The yarn of claim 1 wherein said relative viscosity is greater than about 60.

10. The yarn of claim 1 wherein said polyamide is comprised of homopolymer poly(hexamethylene adipamide).

11. The yarn of claim 10 having an apparent crystallite size of greater than about 53 Å measured in the 100 plane wherein apparent crystallite size is calculated from the 23 and 21 degree peak half heights and widths as measured by X-ray diffraction.

12. The yarn of claim 1 wherein said yarn has a normalized elastic range of greater than about 0.55 wherein normalized elastic range is measured on single filaments as the stress difference between the end points over the linear region of the stress strain curve between the initial and secondary yield points divided by the breaking stress of the filament.

13. The yarn of claim 1 wherein said yarn has a normalized yield stress of greater than about 0.78 wherein normalized yield stress is defined as the stress measured on single filament stress strain curves at the secondary yield point divided by the breaking stress of the filament.

14. The yarn of claim 1 having a density of at least 1.143 g/cc.

* * * * *